US009468305B2

(12) United States Patent
Flora

(10) Patent No.: US 9,468,305 B2
(45) Date of Patent: Oct. 18, 2016

(54) FOLDING BED FOR SPACE SAVING STORAGE WITHIN A CABINET

(71) Applicant: Iqbal Singh Flora, Abbotsford (CA)

(72) Inventor: Iqbal Singh Flora, Abbotsford (CA)

( * ) Notice: Subject to any disclaimer, the term of this patent is extended or adjusted under 35 U.S.C. 154(b) by 0 days.

(21) Appl. No.: 14/340,502

(22) Filed: Jul. 24, 2014

(65) Prior Publication Data

US 2016/0022048 A1 Jan. 28, 2016

(51) Int. Cl.

| | |
|---|---|
| ***A47C 17/38*** | (2006.01) |
| ***A47C 17/58*** | (2006.01) |
| ***A47C 17/52*** | (2006.01) |
| ***A47C 17/60*** | (2006.01) |

(52) U.S. Cl.

CPC ..... *A47C 17/58* (2013.01); *A47C 17/52* (2013.01); *A47C 17/60* (2013.01)

(58) Field of Classification Search

CPC ..... A47C 17/52; A47C 17/58; A47C 17/60
See application file for complete search history.

(56) References Cited

U.S. PATENT DOCUMENTS

| | | | | |
|---|---|---|---|---|
| 3,792 | A | | 10/1844 | Kingman |
| 74,494 | A | | 2/1868 | Burr |
| 83,936 | A | | 11/1868 | Crosby |
| 102,012 | A | | 4/1870 | Kelly |
| 156,986 | A | | 11/1874 | Crosby |
| 179,013 | A | | 6/1876 | Green |
| RE8,270 | E | | 6/1878 | Maine |
| 219,342 | A | | 9/1879 | Boyington |
| 220,173 | A | | 9/1879 | Reichkert |
| 225,393 | A | | 3/1880 | Kendrick |
| 230,397 | A | | 7/1880 | Boyington |
| 239,805 | A | | 3/1881 | Knapp |
| 253,903 | A | | 2/1882 | Witmer |
| 261,006 | A | | 7/1882 | Logan |
| 261,053 | A | | 7/1882 | Shupe |
| 262,817 | A | | 8/1882 | Morrison |
| 391,424 | A | | 10/1888 | Poulson |
| 417,108 | A | | 12/1889 | Snyder |
| 431,825 | A | | 7/1890 | Sundback |
| 433,845 | A | | 8/1890 | Argerbright |
| 445,629 | A | | 2/1891 | Osgood |
| 476,923 | A | | 6/1892 | Hayton et al. |
| 504,778 | A | | 9/1893 | Flory |
| 510,084 | A | | 12/1893 | Odegaard et al. |
| 547,170 | A | | 10/1895 | Karp |
| 637,670 | A | * | 11/1899 | Sanor ..... A47C 17/58 5/147 |
| 673,536 | A | | 5/1901 | Hamilton |

(Continued)

FOREIGN PATENT DOCUMENTS

| | | | |
|---|---|---|---|
| CN | 87203349 | U | 5/1987 |

*Primary Examiner* — David E Sosnowski
(74) *Attorney, Agent, or Firm* — Mark A Hopkinson; Hopkinson Intellectual Property Law

(57) ABSTRACT

A folding bed for storage within a cabinet has a flat platform made from a front panel and an inside front panel. Rear extension panels are hingedly attached to the rear face of a drawer such that in the closed cabinet position the rear extension panels are parallel to the rear drawer face and moveable when in the open bed position to be parallel with the side drawer faces. The cabinet sides and the cabinet top have hinges to permit opening up the upper structural section.

A method of transforming an apparatus from a cabinet to a bed pulling out a base drawer involves unfolding panels to form a platform out of a front panel, an inside panel and a cabinet floor, unfolding a mattress from within the apparatus onto the platform, and unfolding side panels to reduce visible obstructions.

20 Claims, 7 Drawing Sheets

(56) References Cited

U.S. PATENT DOCUMENTS

| | | | | | |
|---|---|---|---|---|---|
| 756,162 | A | | 3/1904 | Faschian | |
| 791,857 | A | | 6/1905 | Arnold | |
| 915,651 | A | | 3/1909 | Appel | |
| 939,482 | A | | 11/1909 | Douglass | |
| 1,073,674 | A | | 9/1913 | Giordano | |
| D45,708 | S | | 1/1914 | Giordano | |
| 1,087,679 | A | | 2/1914 | Page | |
| 1,121,636 | A | | 12/1914 | Kreczkowski | |
| 1,186,202 | A | | 6/1916 | Jasinski | |
| 1,253,872 | A | | 1/1918 | Page | |
| 1,331,599 | A | * | 2/1920 | Vohralik | A47C 17/48 108/33 |
| 1,338,741 | A | | 4/1920 | Lipshitz | |
| 1,368,101 | A | * | 2/1921 | Bettegar | A47C 17/60 5/149 |
| 1,409,770 | A | | 3/1922 | Piatkowski | |
| 1,413,595 | A | | 4/1922 | Kreuzkamp | |
| 1,558,012 | A | | 10/1925 | Henry | |
| 1,618,642 | A | * | 2/1927 | Diamond | A47C 17/58 5/149 |
| 1,795,697 | A | * | 3/1931 | Abela | A47C 17/48 5/154 |
| 2,313,847 | A | | 3/1943 | Thomas | |
| 2,356,321 | A | | 8/1944 | Irick | |
| 2,462,524 | A | | 2/1949 | Mattedi | |
| D159,608 | S | | 8/1950 | Godschalk | |
| 2,547,863 | A | | 4/1951 | Godschalk | |
| 2,618,789 | A | | 11/1952 | Kane | |
| 2,835,904 | A | | 5/1958 | Von Ehr | |
| 2,856,612 | A | | 10/1958 | Wheeler | |
| 3,097,369 | A | | 7/1963 | Emch | |
| 3,224,015 | A | | 12/1965 | Schneider | |
| 3,638,249 | A | | 2/1972 | Katsigarakis | |
| 3,755,832 | A | | 9/1973 | Bennett | |
| 3,828,375 | A | | 8/1974 | Driver | |
| 3,852,837 | A | | 12/1974 | Eakins | |
| 3,858,253 | A | | 1/1975 | Lauzon | |
| 3,965,498 | A | | 6/1976 | Boni | |
| 4,793,011 | A | | 12/1988 | Eve | |
| 4,999,865 | A | * | 3/1991 | Sauder | A47C 17/58 5/149 |
| 5,446,932 | A | | 9/1995 | Voorhis | |
| D369,247 | S | | 4/1996 | Anderson | |
| 5,601,348 | A | | 2/1997 | Minkovski | |
| 5,611,414 | A | | 3/1997 | Walker | |
| D388,632 | S | | 1/1998 | Kelley | |
| 5,913,769 | A | | 6/1999 | Byma et al. | |
| D443,997 | S | | 6/2001 | Stout | |
| 6,425,151 | B2 | | 7/2002 | Barnett | |
| 6,851,139 | B2 | | 2/2005 | Arason et al. | |
| D508,796 | S | | 8/2005 | Juneau | |
| 7,013,506 | B2 | | 3/2006 | Revels | |
| D530,938 | S | | 10/2006 | Netto et al. | |
| 7,425,045 | B2 | | 9/2008 | Harari et al. | |
| 7,574,758 | B2 | | 8/2009 | Arason et al. | |
| D608,560 | S | | 1/2010 | Chen | |
| 7,793,366 | B2 | | 9/2010 | Stoltzfus | |
| 8,407,830 | B1 | | 4/2013 | Kumar | |
| 8,566,980 | B2 | | 10/2013 | Grone | |
| 8,572,776 | B2 | | 11/2013 | Grubb | |
| D712,676 | S | | 9/2014 | Flora | |
| D742,136 | S | | 11/2015 | Flora | |
| 2004/0093669 | A1 | * | 5/2004 | Arason | A47C 19/122 5/159.1 |
| 2006/0031986 | A1 | * | 2/2006 | Revels | A47C 17/38 5/136 |
| 2006/0107456 | A1 | * | 5/2006 | Joseph | A47C 17/58 5/2.1 |
| 2006/0225210 | A1 | * | 10/2006 | Arason | A47C 17/58 5/159.1 |
| 2006/0230530 | A1 | * | 10/2006 | Avishay | A47C 17/38 5/136 |

* cited by examiner

FOLDING BED FOR SPACE SAVING STORAGE WITHIN A CABINET

TECHNICAL FIELD

This application relates to the field of foldable beds, and particularly to temporary beds that can be stored within a finished piece of furniture.

CROSS REFERENCE TO RELATED APPLICATIONS

None.

GOVERNMENT SUPPORT

None.

BACKGROUND

Beds take up a large amount of floor space within a room. When beds are not required frequently, or when the space is otherwise needed, it is helpful to have a bed that can be stored off the floor in a smaller footprint.

Various types of beds that can be folded away into furniture have been known for more than a century.

U.S. Pat. No. 179,013 titled "Improvement in Cabinet-Bedsteads" issued to Green on Jun. 20, 1876. Green disclosed a bed that folded up into a cabinet that had a functional bottom drawer that could be extended to partially support the bed. The unfolding and folding of the Green bed is cumbersome.

U.S. Pat. No. 7,574,758 to Arason et al. discloses a folding cabinet bed with a telescoping slide out support platform. The Arason bottom drawer loses considerable storage space due to the significant space taken up by multiple side panels and central panels. In operation as a bed, the Arason cabinet side walls do not open but remain as obstructions that may be undesirable to a person attempting to sleep in the bed.

There exists a need for collapsible bed that is comfortable and functional when used as a bed, but can also be easily folded up into an attractive piece of furniture so that valuable floor space no longer taken up by the bed when the bed is not in use.

SUMMARY OF INVENTION

Apparatus is provided for transforming a modified cabinet into a bed. An upper structural section has a rear cabinet panel and a cabinet top. The cabinet top is orthogonal to the rear cabinet panel and attached to the rear cabinet panel along a top edge. The two cabinet sides are orthogonal to the rear cabinet panel and orthogonal to the cabinet top. The cabinet sides are attached to the rear cabinet panel along a side edge.

Two side supports are provided on top of a cabinet floor, the side supports being sized and structured to support an underside of the cabinet top. A movable sleeping portion has a front cabinet panel hingedly attached along a bottom edge to the cabinet floor and an inside front panel hingedly attached along a top edge to the front cabinet panel. The front cabinet panel and the inside front panel are moveable between a closed position orthogonal to the cabinet floor and the cabinet top and parallel to the rear cabinet panel to an open position parallel to the cabinet floor and the cabinet top and orthogonal to the rear cabinet panel. A base section has two base side panels and a drawer having a front drawer face, a rear drawer face, and two side drawer faces. The drawer base is orthogonal to the front, rear and side drawer faces. Rear extension panels hingedly attached to the rear drawer face and to the base side panel such that when in the closed cabinet position the rear extension panels are parallel to the rear drawer face and moveable when in the open bed position to be parallel to the side drawer faces. A hinge bisects each of the cabinet sides. The cabinet sides are movable between a closed position where each bisected portion is coplanar and an open position where each bisected portion is parallel but not coplanar.

A hinge bisects the cabinet top, the cabinet top being movable between a closed position where each bisected portion is coplanar and an open position where each bisected portion is orthogonal. A central support can be provided on top of the cabinet floor, the central support being sized and structured to support an underside of the cabinet top.

The cabinet sides can be movable to an open position parallel to the rear cabinet panel.

In the open position, the visible width of the cabinet sides does not obstruct or block a side view through the upper structural section in at least a central portion of the upper structural section. The area opened up by opening the cabinet sides, in at least a central portion of the upper structural section can be more than half the width of the cabinet sides, and preferably at least 60% more open than when the cabinet sides are closed.

A locking mechanism can be attached to the side panels and to the cabinet front panel for releasably securing the side panels to the cabinet front panel.

Wheels are attached to an underside of the drawer base and wheels are attached to an underside of the rear extension panels.

A method for transforming an apparatus from a cabinet to a bed is provided in accordance with this invention. The method includes pulling out a base drawer, removing pillows and bedding from the base drawer, unlocking a locking mechanism securing a front cabinet panel to a side panel and folding the front cabinet panel down onto panels secured to a rear face of the base drawer. An inside front panel is unfolded onto the base drawer such that a flat platform is formed out of the front cabinet panel, the inside front panel and a cabinet floor. A mattress can be unfolded from within the apparatus. The mattress can be laid onto the flat platform to form a bed. The cabinet side panels can be unfolded to reduce visible obstructions.

BRIEF DESCRIPTION OF DRAWINGS

In Figures which illustrate non-limiting embodiments of the invention.

DESCRIPTION

Figure 1:
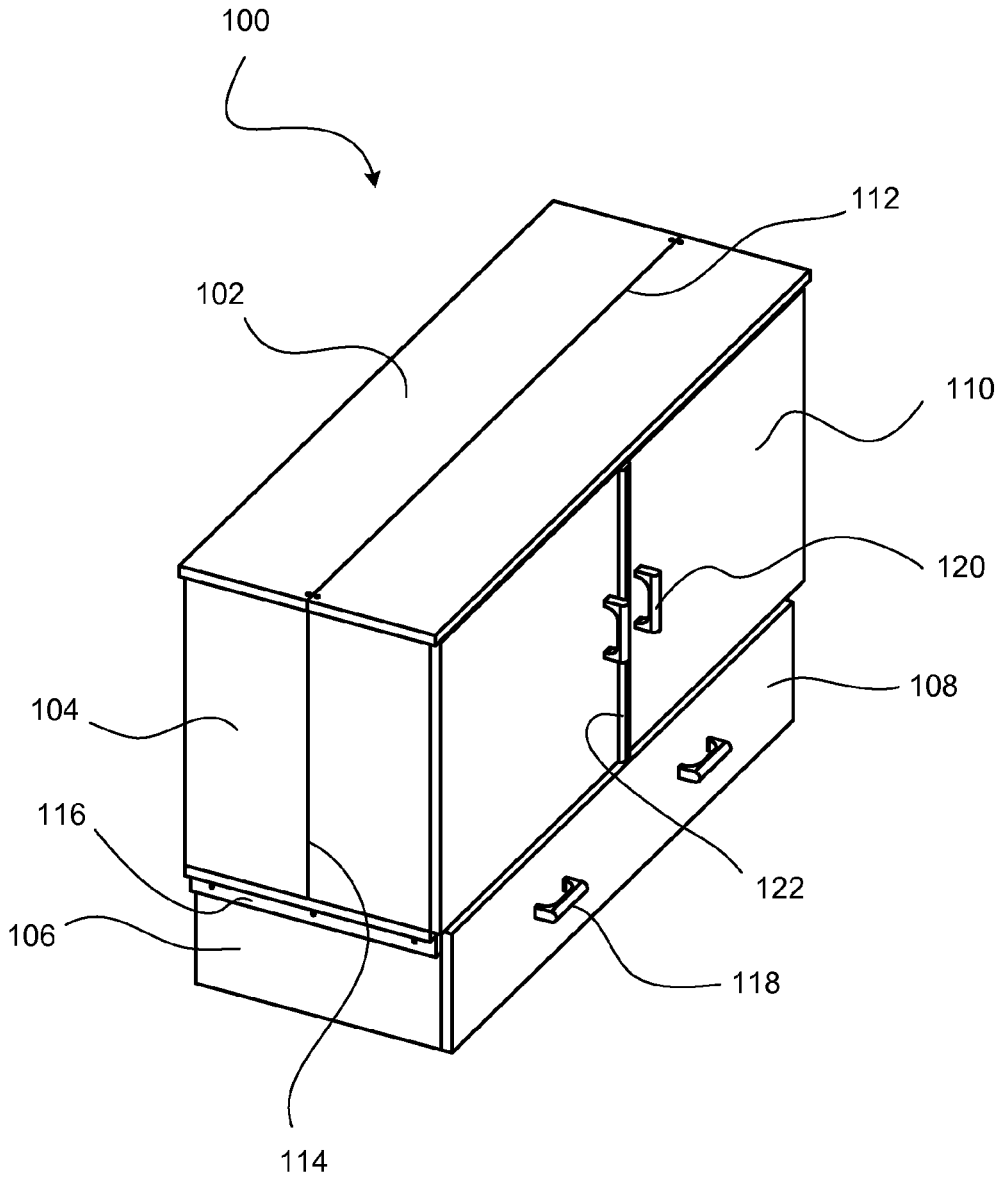
FIG. 1 is a perspective view of an embodiment of the invention in a closed position.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

With reference to FIGS. 1-4 and 7-8, embodiment 100 is a foldout cabinet bed having a cabinet top 102, a cabinet side 104, a base side panel 106, a bottom drawer front 108 and an upper cabinet front panel 110. A hinge 112 may separate two halves of cabinet top 102 and a hinge 114 may separate two halves of cabinet side 104.

Bottom drawer front 108 may feature any knobs or handles 118 of suitable decor, which may be chosen to match handles 120 on cabinet front panel 110. The cabinet front panel 110 may further feature one or more decorative front contours 122 such as an inward bevel or an outward bevel to provide the appearance that the cabinet front panel 110 is divided into two or more sections such as cabinet doors or drawers.

The base side panels 106 in embodiment 100 are set on a smaller footprint than the top section such that cabinet sides 104 are offset therefrom. Support 116 may be used to increase stability and rigidity in the cabinet as it braces the offset difference between the location of base side panel 106 and cabinet side 104.

The top cabinet structure may be opened by rotating cabinet sides 104 outward on hinges attached to the rear cabinet panel 148 or attached to side support structures 125. The side support structures 125 have a side support base 124 and a side support top 126 that allow distribution of weight from the cabinet top 102 to be supported by the cabinet floor 146 while allowing a much more open view. When used as a bed with the rear cabinet panel 148 as a headboard, a person sleeping will be able to enjoy a much more open side view than had the cabinet sides 104 been fixed in place and/or if the side support structure 125 were not designed to support the necessary weight of the cabinet top 102 while permitting viewing therethrough.

It is to be understood that other variations of the side support structures 125 are possible, including structures that are transparent or that have one or more viewing holes therethrough, as long as they are sturdy enough to support the appropriate weight.

Figure 2:
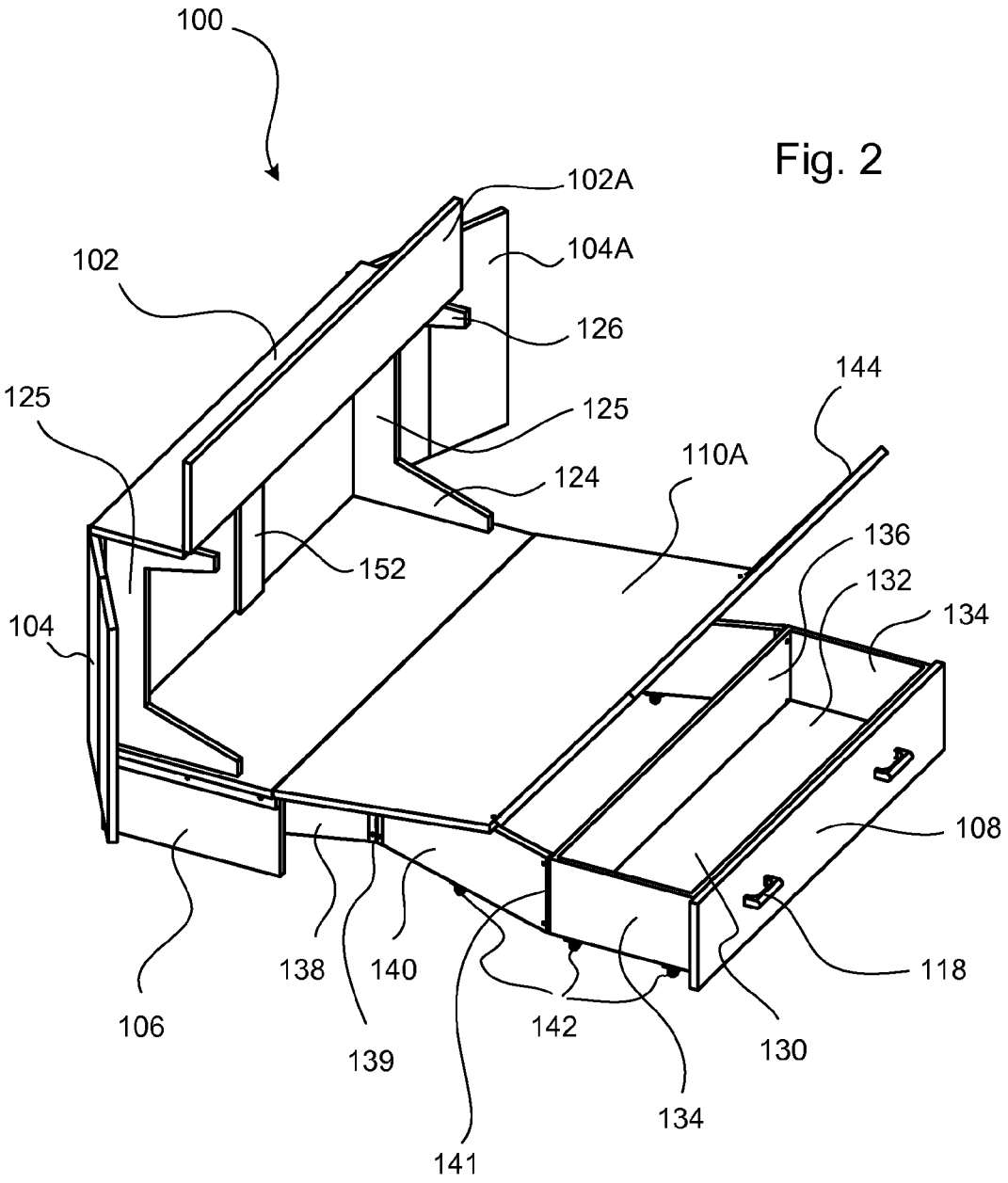
FIG. 2 is a perspective view of the embodiment of FIG. 1 in a partially open position.

In the partially open view of FIG. 2 the drawer 130 is shown having a drawer base 132, drawer sides 134 and a drawer rear face 136.

Drawer 130 is pulled out of its storage position to form a base for the bed platform. Bifold support panels 138 and 140 are attached to each other via hinge 139. Support panel 140 is also attached to drawer 130 by hinge 141. Support panel 138 is attached to the inside of base side panel 106 via hinge 149. The drawer base bottom face 132A of drawer 130 and support panels 138 and 140 have castors or wheels 142 to allow easy sliding along the floor to open and close the drawer from closed to an extended open position.

It is preferable that wheels 142 on rear extension panels 138 and 140 be able to freely rotate so that the wheels can face forward as panels 138 and 140 are rotated around hinges 141, 139 and 149.

Figure 3:
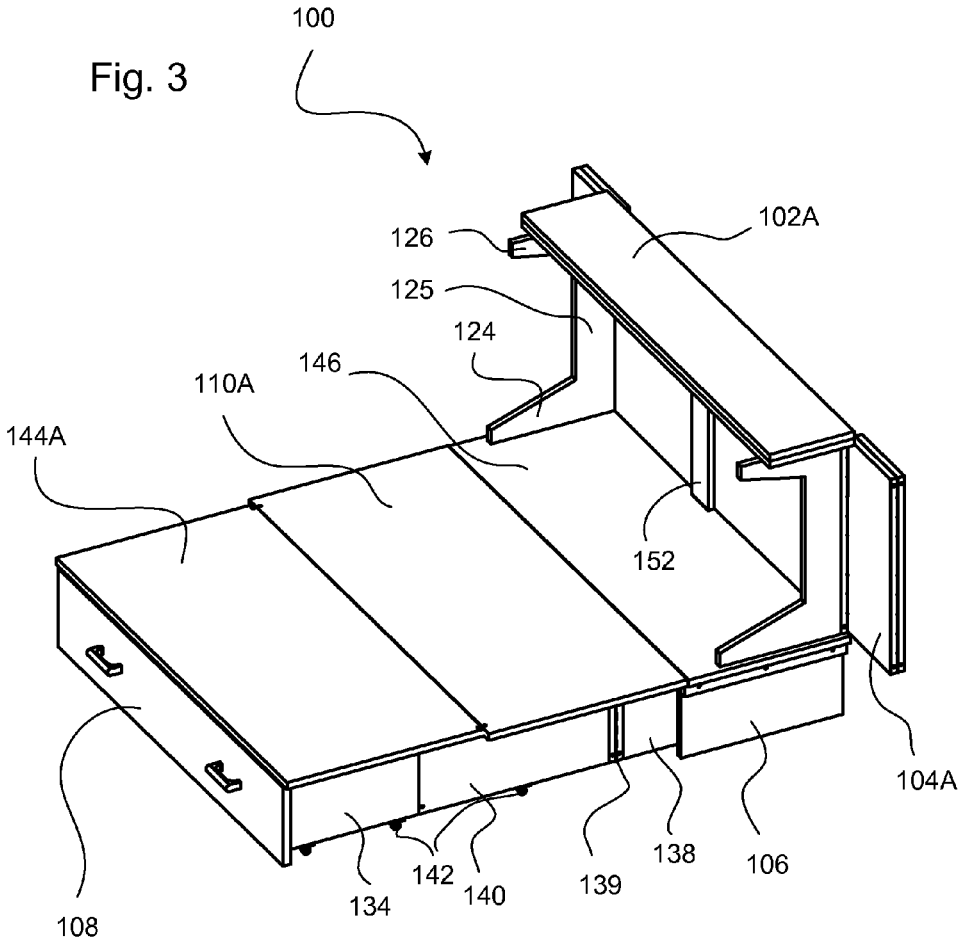
FIG. 3 is a perspective view of the embodiment of FIG. 1 in a fully open position.
Figure 4:
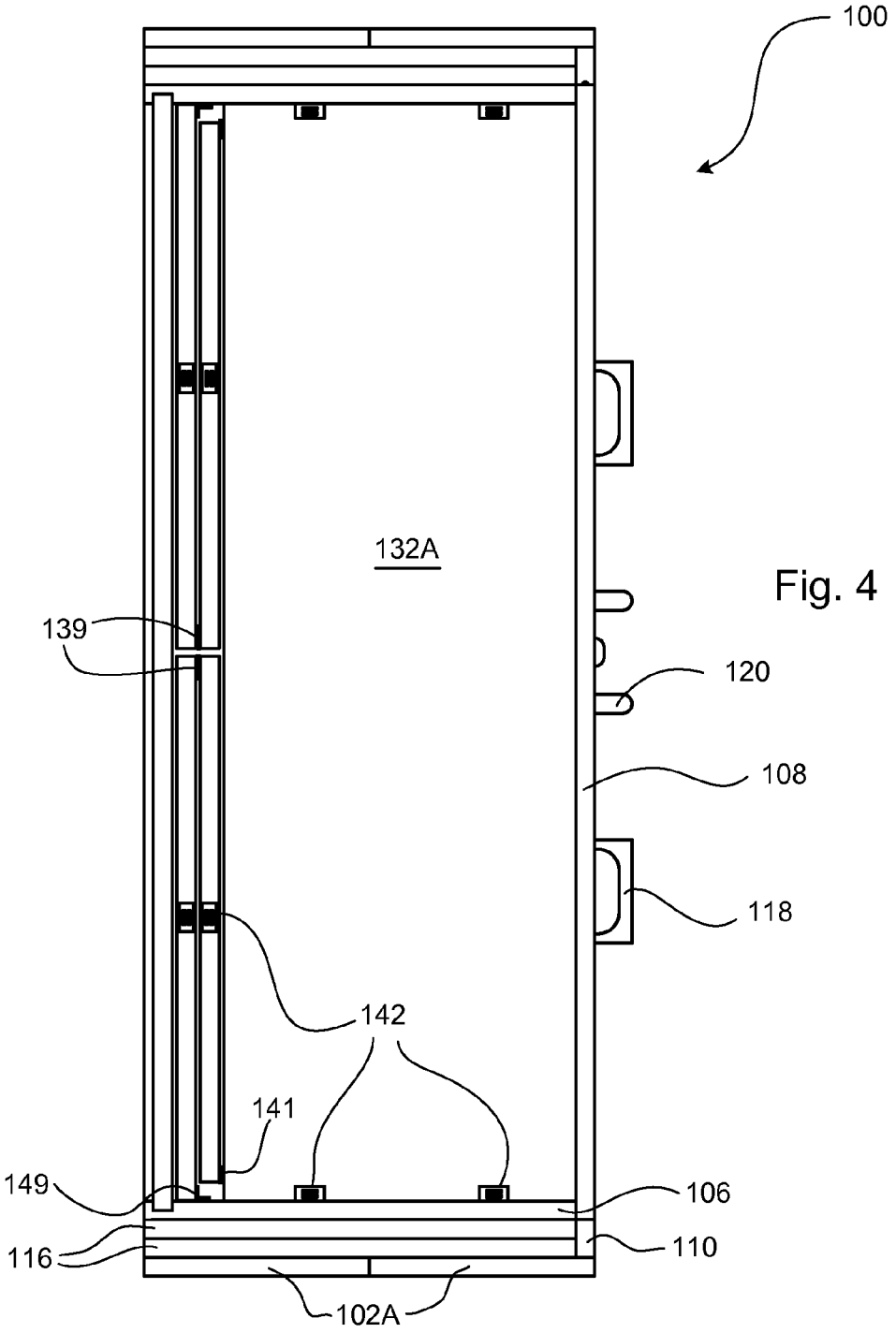
FIG. 4 is a bottom view of the embodiment of FIG. 1 in the closed position.
Figure 5:
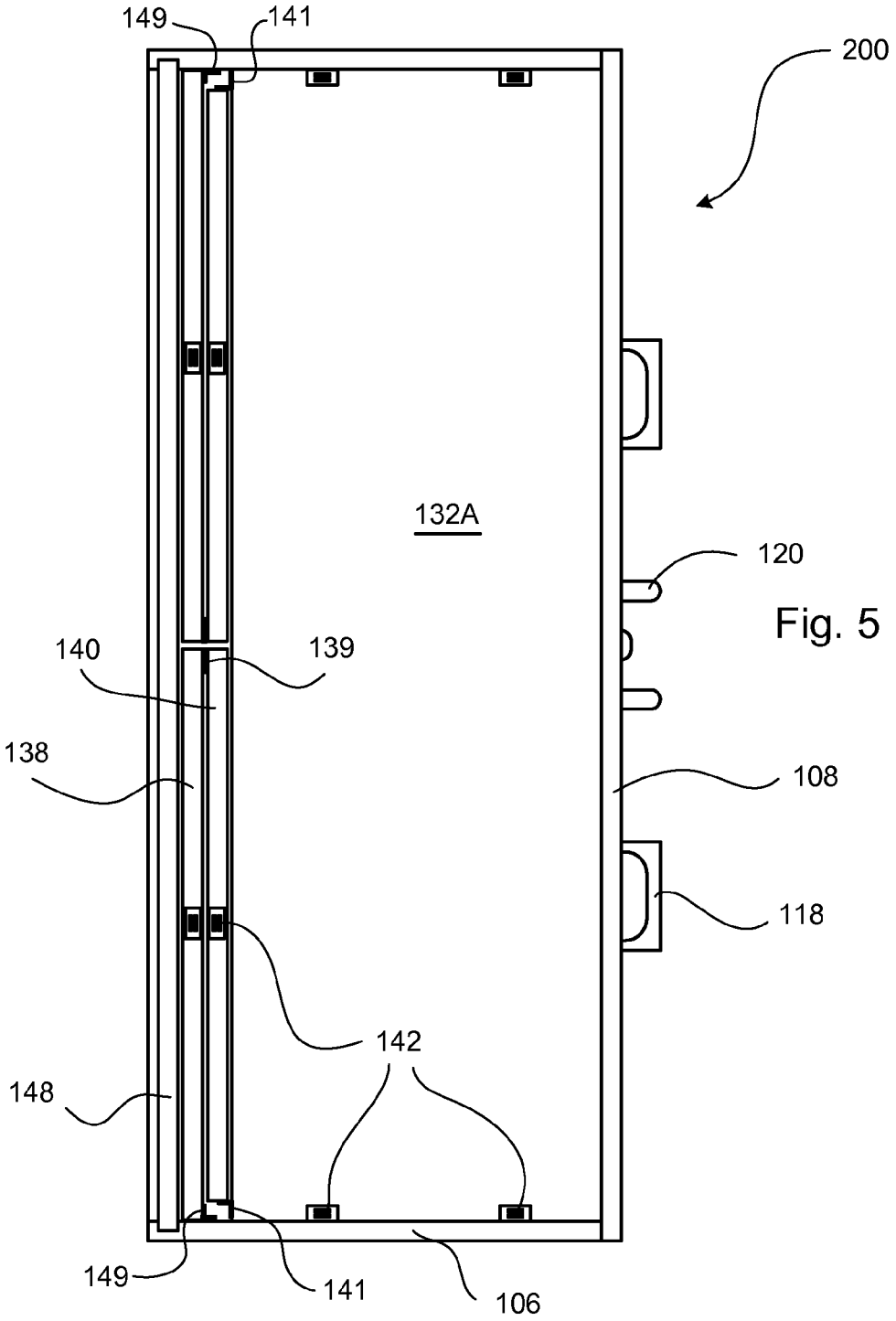
FIG. 5 is a bottom view of another embodiment of the invention in a closed position.
Figure 6:
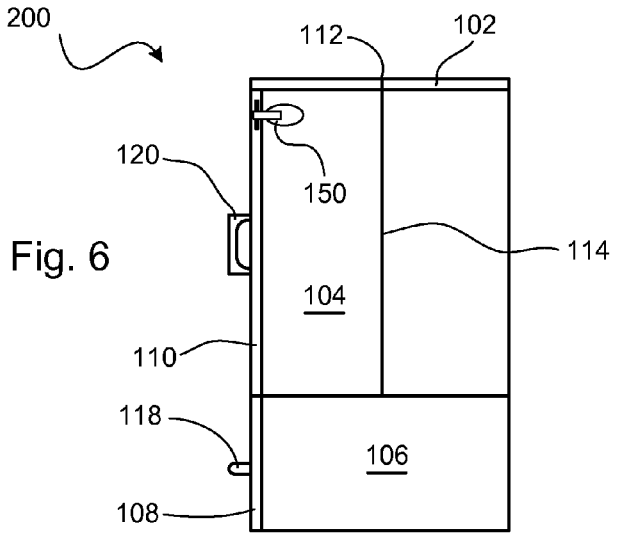
FIG. 6 is a side elevation view of the embodiment of FIG. 5 in the closed position.
Figure 7:
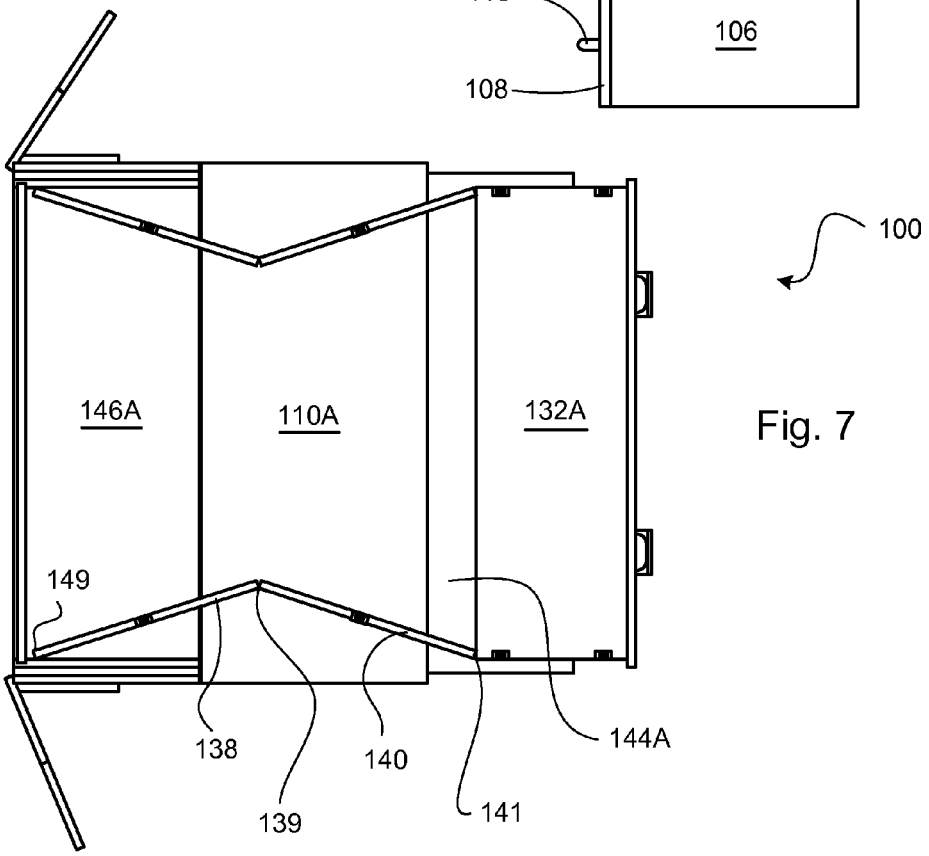
FIG. 7 is a bottom view of the embodiment of FIG. 1 in a partially open position.

The overall strength of the cabinet structure may be increased by adding central back support 152 shown in FIGS. 2 and 3.

As shown in FIGS. 2 and 3, cabinet top 102 may be rotated open around top hinge 112 to reveal the cabinet top underside 102A. In embodiment 100 the cabinet top 102 rotates completely back upon itself as shown in FIG. 3. In alternative embodiments the cabinet top 102 may only open to the 90 degree position shown in FIG. 2, for example if tension or hydraulic hinges are chosen to soften the opening and closing of the cabinet top 102.

In the open position, a mattress or suitable cushioning material for sleeping may be placed on the platform created by cabinet floor 146, the front cabinet panel underside 110A and the inside front panel underside 144A.

A mattress can be stored in the cabinet in the space between the front cabinet panel 110 and the rear cabinet panel 148 above the cabinet floor 146 and below the cabinet top 102. Any suitable mattress or similar material may be used. One option is to use a mattress made in three sections which can be hingedly attached by fabric so that it easily folds up and unfolds in sections similar in size to the sections of the platform 146, 110A and 144A.

Embodiment 200 is similar to embodiment 100 but embodiment 200 has the bottom drawer the same width as the top portion of the cabinet. Base side panel 106 is in line with cabinet side 104 above it when in the closed position. This embodiment features additional space in bottom drawer 130 which allows for additional storage of pillows and bedding.

The addition of fastening mechanism 150 such as easy to operate latches or bolts allow cabinet sides 104 to be securely fastened to front cabinet panel 110 such that there would be no danger of front cabinet panel 110 falling open, which might otherwise result in injury or an untidy appearance. Fastening mechanism 150 may be on the cabinet side inside 104A instead or in addition to being on the cabinet side 104.

Fasteners 152 such as screws, glue or rivets can be used to hold various pieces together, including hinges and panels as appropriate.

Additional touches can be added to the apparatus to improve ease of use and/or reduce wear on the parts. For example the topmost surface of the rear extension panels 138 and 140 and the topmost surface of drawer sides 134 and drawer rear face 136 may be coated with felt or other soft surface to reduce sound and to reduce wear on the front cabinet panel 110 and the inside front panel 144. Further, a handle may be added to inside front panel 144 to assist in folding the bed back into a cabinet. The handle on inside front panel 144 would be positioned to face downward in the open position and located in a position that it would not touch the rear extension panels 138 and 140 or any part of the drawer 130.

Figure 8:
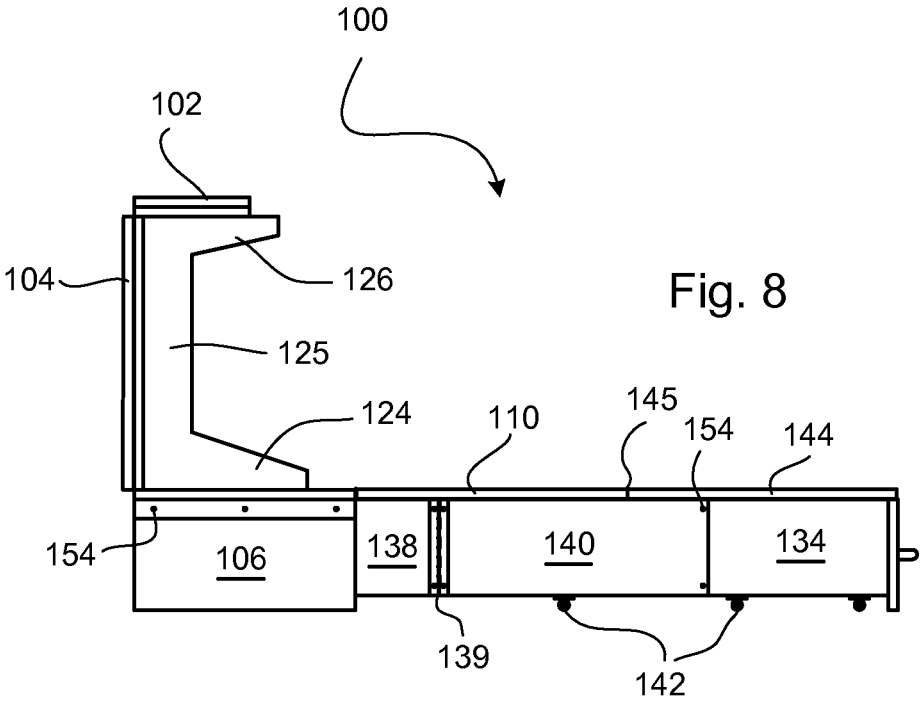
FIG. 8 is a side elevation view of the embodiment of FIG. 1 in a fully open position.

To transition embodiments 100 and 200 between a closed cabinet position as shown in FIG. 1 and an open bed position, for example, as shown in FIG. 3 or 8, a user may begin by pulling out the base drawer 130 and by unlocking a locking mechanism that secures a front cabinet panel 110 to a side panel 104. These steps can occur in either order. When the base drawer 130 is pulled out, the user may remove pillows and bedding from the drawer. The front cabinet panel is folded down onto the topmost surface of the rear extension panels 138 and 140. The inside front panel 144 is folded down onto the base drawer 130. A flat platform is formed out of the front cabinet panel 110, the inside front panel 144 and the cabinet floor 146. A folded mattress stored within the cabinet can be unfolded and laid onto the flat platform. The cabinet side panels 104 can be unfolded to reduce visible obstructions.

The topmost surface of the rear extension panels 138, 140 may be provided with a felt pad upon which the unfolded flat platform can rest.

A cabinet top panel 102 can be unfolded to further reduce visible obstructions. Pulling out the base drawer 130 is performed by rolling the base drawer 130 on a floor. The bed can be made by putting bedding stored in the drawer 130 on the mattress and placing pillows stored in the drawer 130 on the bed.

The step of pulling out the base drawer 130 may involve unfolding rear extension panels 138, 140 hingedly connecting the base drawer 130 to a side base panel 106. In the alternative, the step of pulling out the base drawer 130 could involve extending telescopic rails connecting the base drawer 130 to a rear cabinet panel 148 or to a base side panel 106 as is known in the art, for example as disclosed by Arason.

When unfolding the inside front panel 144 onto the base drawer 130 a handle secured to the inside front panel 144 can be gripped to assist in pivoting the front panel 144 towards the base drawer 130.

As will be apparent to those skilled in the art in the light of the foregoing disclosure the present invention is not limited by what has been particularly shown and described herein. Rather the scope of the present invention includes both combinations and sub-combinations of the features described hereinabove as well as modifications and variations thereof which would occur to a person of skill in the art upon reading the foregoing description and which are not in the prior art. Furthermore, many alterations and modifications are possible in the practice of this invention without departing from the spirit or scope thereof. Accordingly, the scope of the invention is to be construed in accordance with the substance defined by the following claims.

What is claimed is:

1. Apparatus for transforming between a bed and a cabinet, having an upper structural section comprising
- a rear cabinet panel,
- a cabinet top orthogonal to said rear cabinet panel and attached to said rear cabinet panel along a top edge,
- two cabinet sides orthogonal to said rear cabinet panel and orthogonal to said cabinet top, said cabinet sides each attached to said rear cabinet panel along a side edge respectively,
- said cabinet sides being hingedly moveable between a closed cabinet position orthogonal to said rear cabinet panel and an open bed position in which a side view through said upper structural section is not visually blocked at least inside a C-shaped side support structure of said upper structural section,
- a cabinet floor,
- two side supports provided on top of said cabinet floor, said side supports being sized and structured to support an underside of said cabinet top;
- a movable sleeping section comprising
- a front cabinet panel hingedly attached along a bottom edge to said cabinet floor,
- an inside front panel hingedly attached along a top edge to said front cabinet panel,
- said front cabinet panel and said inside front panel being moveable between said closed cabinet position orthogonal to said cabinet floor and said cabinet top and parallel to said rear cabinet panel to said open bed position parallel to said cabinet floor and said cabinet top and orthogonal to said rear cabinet panel;
- and having a base section comprising
- two base side panels,
- a drawer coupled to said base side panels, said drawer having a front drawer face, a rear drawer face, and two side drawer faces and a drawer base orthogonal to said front, rear and side drawer faces.

2. An apparatus as in claim 1, further comprising a hinge bisecting each of said cabinet sides, said cabinet sides being movable between said closed cabinet position wherein each bisected portion is coplanar and said open bed position where each bisected portion is not coplanar.

3. An apparatus as in claim 1, further comprising a hinge bisecting said cabinet top, said cabinet top being movable between a closed position where each bisected portion is coplanar and an open position where each bisected portion is orthogonal.

4. An apparatus as in claim 1, further comprising a central support provided on top of said cabinet floor, said central support being sized and structured to support an underside of said cabinet top.

5. An apparatus as in claim 1, said cabinet sides being movable to an open position parallel to said rear cabinet panel.

6. An apparatus as in claim 5, further comprising a locking mechanism for securing said side panels to said cabinet front panel.

7. An apparatus as in claim 6, further comprising wheels attached to an underside of said drawer base and wheels attached to an underside of said rear extension panels.

8. An apparatus as in claim 7, further comprising a felt coating applied to a topmost surface of said drawer sides.

9. An apparatus as in claim 1, wherein said drawer is coupled to said base side panels via rear extension panels hingedly attached to said rear drawer face and to said base side panel such that when in the closed cabinet position the rear extension panels are parallel to the rear drawer face and are moveable to parallel to said side drawer faces when in the open bed position.

10. Apparatus for transforming between a bed and a cabinet, having an upper structural section comprising
- a rear cabinet panel,
- a cabinet top orthogonal to said rear cabinet panel and attached to said rear cabinet panel along a top edge,
- two cabinet sides orthogonal to said rear cabinet panel and orthogonal to said cabinet top, said cabinet sides each attached to said rear cabinet panel along a side edge respectively,
- a cabinet floor,
- two side supports provided on top of said cabinet floor, said side supports being sized and structured to support an underside of said cabinet top;
- a movable sleeping section comprising
- a front cabinet panel hingedly attached along a bottom edge to said cabinet floor,
- an inside front panel hingedly attached along a top edge to said front cabinet panel,
- said front cabinet panel and said inside front panel being moveable between a closed cabinet position orthogonal to said cabinet floor and said cabinet top and parallel to said rear cabinet panel to an open bed position parallel to said cabinet floor and said cabinet top and orthogonal to said rear cabinet panel;
- and having a base section comprising
- two base side panels, a drawer having a front drawer face, a rear drawer face, and two side drawer faces and a drawer base orthogonal to said front, rear and side drawer faces, rear extension panels hingedly attached to said rear drawer face and to said base side panel such that when in the closed cabinet position the rear extension panels are parallel to the rear drawer face and moveable when in the open bed position are parallel to said side drawer faces;

a hinge bisecting each of said cabinet sides, said cabinet sides being movable between a closed position where each bisected portion is coplanar and an open position where each bisected portion is parallel but not coplanar;

a hinge bisecting said cabinet top, said cabinet top being movable between a closed position where each bisected portion is coplanar and an open position where each bisected portion is orthogonal;

a central support provided on top of said cabinet floor, said central support being sized and structured to support an underside of said cabinet top;

said cabinet sides being movable to an open position parallel to said rear cabinet panel;

wherein more than half of the width of said cabinet sides is not blocking a side view through said upper structural section in at least a central portion of said upper structural section;

a locking mechanism attached to said side panels to said cabinet front panel for releasably securing said side panels to said cabinet front panel; and wheels attached to an underside of said drawer base, and wheels attached to an underside of said rear extension panels, said wheels attached to said underside of said rear extension panels via rotatable attachment permitting the wheels to face forward as said rear extension panels unfold about said hinges moving from said closed cabinet position to said open bed position.

11. A method of transforming the apparatus of claim 1 from a cabinet to a bed comprising pulling out a base drawer;

folding a front cabinet panel down onto rear extension panels secured to a rear face of said base drawer;

unfolding an inside front panel onto said base drawer;

forming a flat platform out of said front cabinet panel, said inside front panel and a cabinet floor;

unfolding cabinet side panels to reduce visible obstructions.

12. The method of claim 11 further comprising unfolding a cabinet top panel to reduce visible obstructions.

13. The method of claim 12 wherein pulling out a base drawer comprises rolling said base drawer on a floor.

14. The method of claim 13 further comprising removing pillows and bedding from said base drawer;

unlocking a locking mechanism securing said front cabinet panel to a side panel;

unfolding a mattress from within the apparatus; and laying said mattress onto said flat platform.

15. The method of claim 14 further comprising making the bed by putting said bedding and said pillows on said mattress.

16. The method of claim 15 wherein pulling out a base drawer further comprises unfolding rear extension panels hingedly connecting said base drawer to a side base panel.

17. The method of claim 16 wherein forming a flat platform comprises laying said inside front panel on a felt pad on a topmost surface of said rear extension panels.

18. The method of claim 17 wherein unfolding an inside front panel onto said base drawer comprises gripping a handle secured to the inside front panel to assist in pivoting the front panel towards said base drawer.

19. The method of claim 15 wherein pulling out a base drawer further comprises extending telescopic rails connecting said base drawer to a rear cabinet panel.

20. The method of claim 15 wherein pulling out a base drawer further comprises extending telescopic rails connecting said base drawer to a base side panel.

* * * * *